US005477896A

United States Patent [19]

Grifols Lucas

[11] Patent Number: 5,477,896

[45] Date of Patent: Dec. 26, 1995

[54] APPARATUS FOR THE STERILE FILLING OF STERILE BAGS FOR PERFUSION LIQUIDS AND FOR CHECKING THIS FILLING

[76] Inventor: Victor Grifols Lucas, Can Guasch, s/n Polfgono Levante, Parets del Valles (Barcelona), Spain

[21] Appl. No.: 201,884

[22] Filed: Feb. 24, 1994

[30] Foreign Application Priority Data

Mar. 16, 1993 [ES] Spain ..... 9300684

[51] Int. Cl.[6] ..... B65B 55/02

[52] U.S. Cl. ..... 141/83; 141/18; 141/64; 141/67; 141/94; 141/114; 141/313; 73/38

[58] Field of Search ..... 141/10, 51, 63, 141/64, 67, 83, 114, 18, 21, 313, 314, 317, 329, 330, 94; 73/38

[56] References Cited

U.S. PATENT DOCUMENTS

| | | | |
|---|---|---|---|
| 3,251,218 | 5/1966 | Russell | 73/38 X |
| 4,369,898 | 1/1983 | Andersson | 73/38 X |
| 4,712,590 | 12/1987 | Gianfilippo | 141/83 |
| 4,807,676 | 2/1989 | Cerny et al. | 141/83 X |
| 4,842,028 | 6/1989 | Kaufman et al. | 141/114 |

FOREIGN PATENT DOCUMENTS

| | | |
|---|---|---|
| 0476194A1 | 9/1990 | European Pat. Off. . |
| 0476194 | 3/1992 | European Pat. Off. . |
| 9103692 | 12/1991 | Spain . |

*Primary Examiner*—J. Casimer Jagyna
*Attorney, Agent, or Firm*—Darby & Darby

[57] ABSTRACT

The machine has a pump for the metering, at controlled pressure, of the perfusion liquid to the bag which is connected to the machine. Compressed air is supplied to the filter in the bag when it has been filled in order to check the bubble point. The machine includes a purifying filter, pressure transductor and connections to the liquid pipe as well as a suspended support for controlling the filling of the bag. The bag to be filled is coupled by suspension to the support. A safety system for the handling of the bag comprises front gates for closing the handling zone of the bags.

6 Claims, 3 Drawing Sheets

APPARATUS FOR THE STERILE FILLING OF STERILE BAGS FOR PERFUSION LIQUIDS AND FOR CHECKING THIS FILLING

BACKGROUND OF THE INVENTION

1. Field of the Invention

The present patent relates to an apparatus automatically filling in a sterile manner and checking immediately afterwards the integrity of the filter, for bags for perfusion liquids, providing its function with advantageous features of novelty and usefulness.

2. Description of the Related Art

The apparatus to which the present patent relates is combined with the use of bags for perfusion liquids, in particular the bags corresponding to the Applicants' own invention, which is the subject of Spanish Utility Model No. 9103692 published on Dec. 5, 1991.

Among other highly advantageous technical points, the said bags for perfusion liquids are characterized by their being provided with a sterilizing filter (with pores of 0.22 μm diameter or less) which is highly efficient and enables the perfusion liquids to be sterilized directly.

SUMMARY OF THE INVENTION

The apparatus which is the subject of the present invention comprises the means necessary for fastening and filling the bags and for checking the filters of said bags, for which reason it comprises suitable means for fastening the bag, filling the latter with the required perfusion liquid, passing the liquid through the sterilizing filter to the bag itself and, finally, it comprises the means for checking that the so-called "bubble point" is not lower than necessary in order to ensure that the integrity and type of filter produce the sterilizing effect of each filter incorporated in each bag.

Essentially, the apparatus to which the present patent relates comprises a monobloc body with a dynamometric suspension support for an individual bag for perfusion liquids which also includes a sensor which, by means of an electronic system, is to detect the passage of air through the filter if the "bubble point" is lower than necessary for ensuring the type and/or integrity of the above-mentioned filter, both conditions being necessary for ensuring their sterilizing condition, and furthermore comprising the means for generating the air compressed to a suitable pressure for checking the "bubble point", and the means for driving liquid at a pressure which is not lower than the above "bubble point", by means of a special pump which can receive liquid from a device of larger dimensions, and pass it to the inlet of the bag through the sterilizing filter, passing from this phase, when the bag has reached the programmed weight, to the bubble point checking phase, by means of the insufflation of air at a controlled pressure at the perfusion liquid inlet pipe, for which reason the latter comprises an air intake system which is independent of the perfusion liquid feed assembly.

The apparatus further comprises a front tray for accommodating the bags, supports for larger capacity containers for perfusion liquid, as well as the pressostats for liquid and air, the controls and drives conventional for liquid and air circuits, pumps, etc., and with a safety system for preventing splashes of liquid in the event of the bag breaking, which consists of a plurality of gates of transparent material which are to prevent the machine operating if they are not closed in a suitable manner.

BRIEF DESCRIPTION OF THE DRAWINGS

In the following, the invention will be explained in further detail on the basis of the attached drawings of a preferred embodiment of the invention, given by way of non-limiting example.

DESCRIPTION OF THE PREFERRED EMBODIMENT

Figure 1:
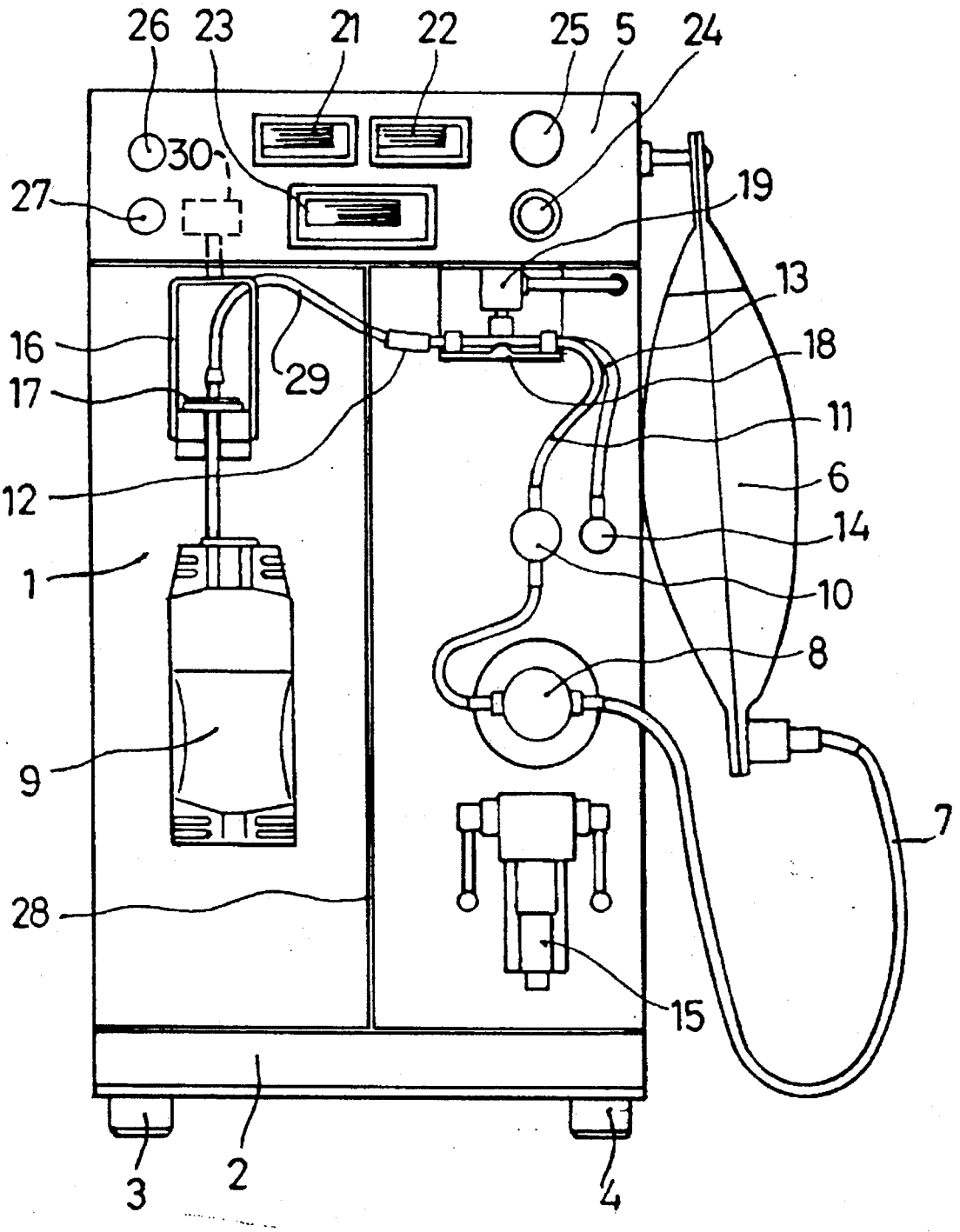
FIG. 1 shows a front elevation view of a machine produced according to the present patent, showing the arrangement of the bag to be filled and of the perfusion liquid container.
Figure 2:
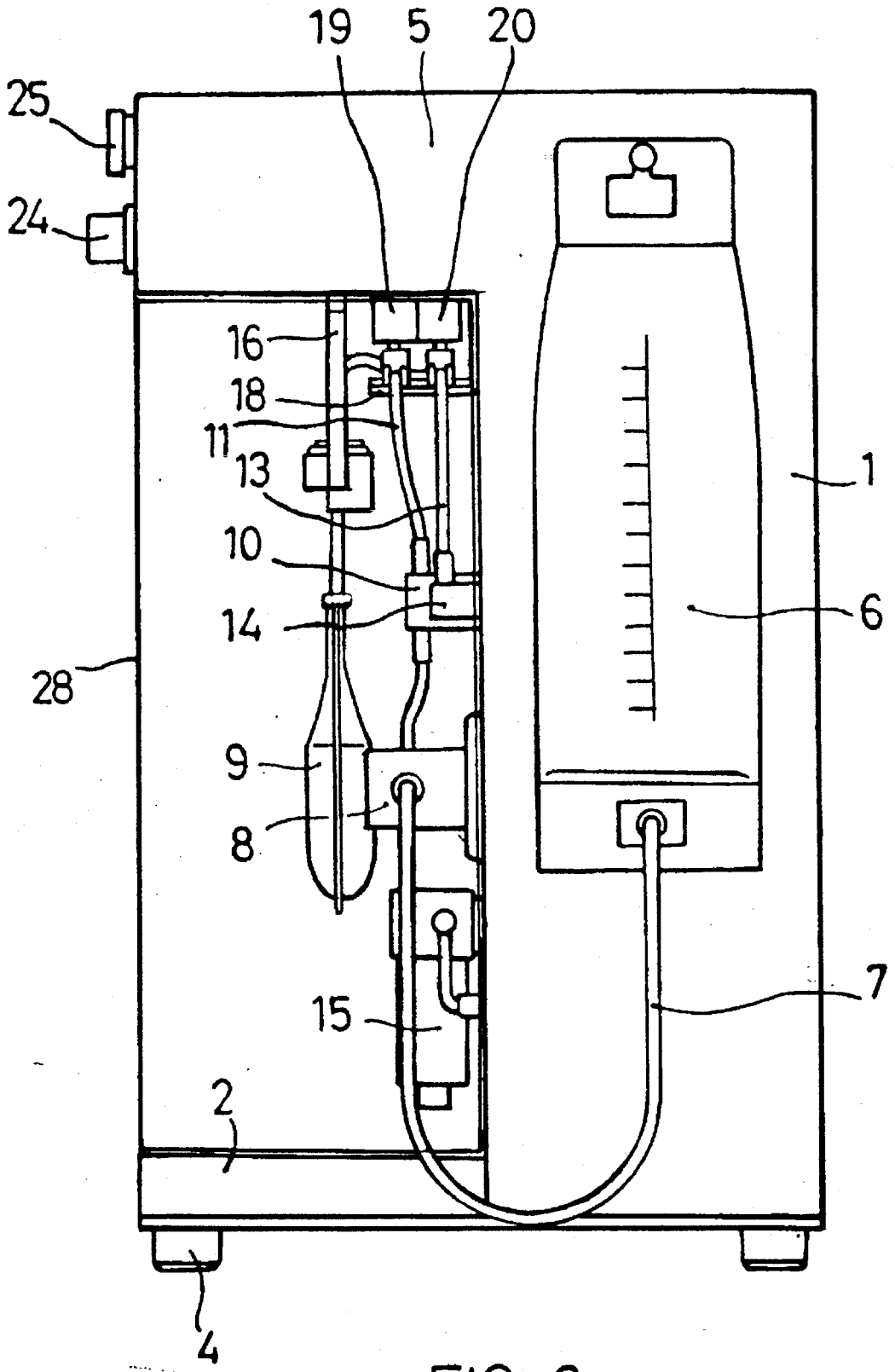
FIG. 2 shows a side elevation view corresponding to the machine shown in FIG. 1.
Figure 3:
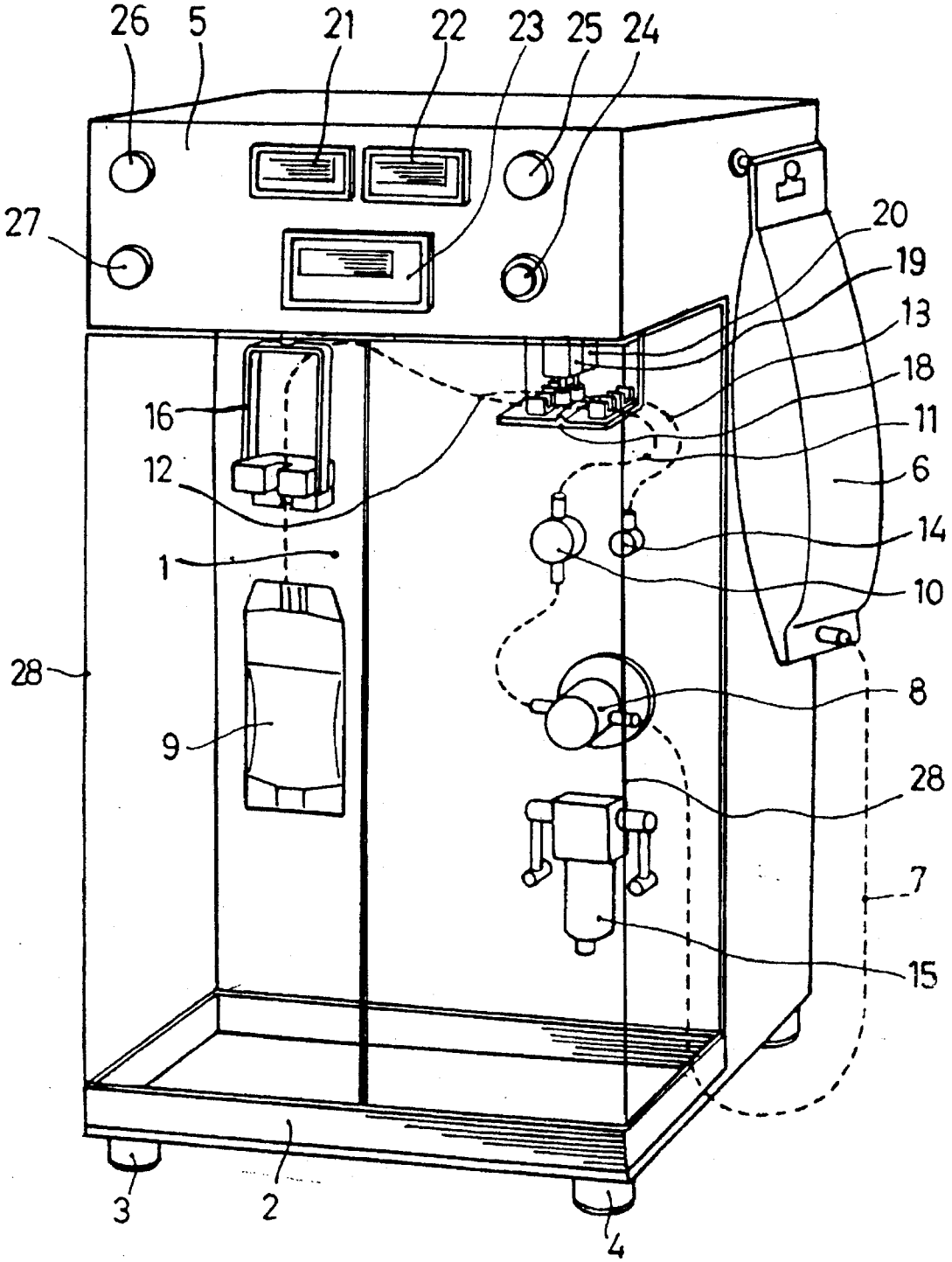
FIG. 3 shows a perspective view of a machine produced according to the present patent, showing schematically the assembly of units.

As shown in the drawings, the machine to which the present patent relates is to perform the automatic metering for each bag and check the bubble point in order to ensure that the conditions for the filter are correct and, therefore, that filtration is effectively sterile. The machine is small in size and of low weight, and comprises the body -1- with the lower container -2- with four support feet, of which the front feet -3- and -4- are shown, and an upper member -5- supporting the machine control panel.

The machine is provided with a principal container -6- for the perfusion liquid, which, via the pipe -7-, supplies a pump -8- for driving the perfusion liquid towards the bag -9- to be filled, by means of a transducer component -10- for the pressure of the liquid which supplies the pipe -11-, which is provided at an intermediate point with a connection -12- for connecting it to the air pipe -13-, which emerges from an air pressure transducer device -14- receiving compressed air from the compression system accommodated in the machine itself and which is provided with a filter and purifying device -15-.

The bag -9- is suspended from the dynamometric pad -30- accommodated in the body -5- by means of the connecting yoke -16-, above which the sterilizing filter -17- is connected.

The operating cycle of the apparatus comprises the positioning of the bag -9- and connection of its sterilizing filter -17- to the feed tube -29-, subsequently continuing with the filling of the bag via the said filter -17- and, in a final phase, checking that the bubble point of the filter -17- is not lower than the necessary minimum by the introduction of air when the programmed weight has been reached, which is detected by the sensor associated with the bag suspension device -16-, which likewise transmits the weight of the perfusion liquid deposited in the bag, such that the latter can be labelled precisely with its specific contents.

The perfusion liquid and air ducts -11- and -13- respectively, which are connected to one another at the connection -12-, also pass through the intermediate support -18-, in which the cylinders preventing the passage of liquid and air -19- and -20- are incorporated.

As an assembly, the liquid and air circuits enable the bag -9- to be filled, when the air previously present in the two pipes has been bled, and likewise the air to be subsequently blown in at a control pressure for the bubble point test in order to check the filter.

The apparatus comprises complementary checking and indicating members preferably in the form of digital indicators -21- and -22- for the air pressure and the liquid pressure as well as an indicator -23- for the weight of the liquid present in the bag -9-. Likewise, the upper body -5-incorporates a pressure regulator -24-, and optical indicators -25- for the liquid pump and an optical alarm indicator -26-, as well as the on/off switch -27-.

In order to protect the operatives in the event of one of the bags breaking or a similar incident, preventing the spillage of liquids which may be dangerous, the apparatus comprises an integral safety system for the front gates 28-, preferably two elements or blades, of which the opening position prevents the machine starting.

The perfusion liquid deposited and incorporated in the apparatus adopts the shape of the bag -9-, which has a large capacity, can be suspended and is interchangeable. Although, in the embodiment illustrated in the figures and described above, the principal device is shown in the form of a bag -6- with a large capacity, it will be appreciated that the said device could vary with respect to its form and also with respect to the materials used. For example, a device made of stainless steel, or other suitable solutions, could be used instead of the bag. Nevertheless, it should be noted that the use of bags represents an advantage from the point of view of ensuring sterility of the perfusion liquid as well as greater ease of handling.

By means of the assembly of units which have been explained, the apparatus is prepared for automatically performing the complete cycle of filling the bags provided with sterile filters for perfusion liquids and checking the bubble point.

It should be noted that the apparatus presents a great advantage in various installations for use in hospitals or the pharmaceutical industry, enabling the complete cycle of filling sterile bags to be performed with a high level of efficiency, and occupying a greatly reduced amount of space.

All that does not affect, alter, change or modify the essence of the machine described will be comprised within the scope of this patent.

I claim:

1. Apparatus for the sterile filling of a sterile bag for perfusion liquids and for verifying this filling, said apparatus comprising:

a) means for metering, at controlled pressure, the perfusion liquid to the bag which is connected to a machine;

b) means for supplying compressed air to a filter in the bag when it has been filled in order to verify the bubble point;

c) means for controlling the filling of the bag connected to the machine; and d) means for determining that the bubble point of the filter is not lower than a predetermined minimum value.

2. Apparatus for the sterile filling of sterile bag for perfusion liquids and for checking this filling according to claim 1, wherein the means for metering the perfusion liquid to the bag to be filled comprises a pump for the liquid which is fed from a larger capacity container attached to the machine, and supplies the machine via a duct incorporating a pressure transducer, and which is supported on an intermediate unit at which, in addition, the air pipe is connected.

3. Apparatus for the sterile filling of sterile bags for perfusion liquid and for checking this filling according to claim 2, wherein the perfusion liquid deposited and incorporated in the apparatus adopts the shape of the bag which has a large capacity, can be suspended and is interchangeable.

4. Apparatus for the sterile filling of sterile bags for perfusion liquids and for checking this filling according to claim 1, the means for determining the bubble point comprises a purifying filter, pressure transducer and connection to the liquid pipe from the intermediate assembly supporting the air and liquid control cylinders.

5. Apparatus for the sterile filling of sterile bags for perfusion liquids and for checking this filling according to claim 1, wherein the means for determining comprises a suspended support associated with the devices for weighing and detecting the bubble point and to which support the bag to be filled is coupled by suspension.

6. Apparatus for the sterile filling of sterile bags for perfusion liquids and for checking this filling, according to claim 1, wherein said apparatus it incorporates a safety system for the handling of the bags, which comprises front gates for closing the handling zone of the bags, the open position of the gates preventing the actuation of the apparatus.

* * * * *